US007772497B2

(12) United States Patent
Clouet et al.

(10) Patent No.: US 7,772,497 B2
(45) Date of Patent: Aug. 10, 2010

(54) SIGNAL TRANSMISSION ELECTRIC WIRE FOR THE AVIATION AND SPACE INDUSTRIES

(75) Inventors: Pascal Clouet, Vigneux sur Seine (FR); Jean-Pierre Ferlier, Yerres (FR); Louis Salvat, Tignieu-Jameyzieu (FR)

(73) Assignee: Nexans (FR)

( * ) Notice: Subject to any disclaimer, the term of this patent is extended or adjusted under 35 U.S.C. 154(b) by 82 days.

(21) Appl. No.: 12/217,296

(22) Filed: Jul. 2, 2008

(65) Prior Publication Data

US 2009/0065234 A1 Mar. 12, 2009

(30) Foreign Application Priority Data

Jul. 10, 2007 (FR) ..... 07 56393

(51) Int. Cl.
*H01B 5/08* (2006.01)

(52) U.S. Cl. ..... 174/128.1; 174/120 R

(58) Field of Classification Search ..... 174/126.1, 174/126.2, 128.1, 128.2, 120 R
See application file for complete search history.

(56) References Cited

U.S. PATENT DOCUMENTS 1,658,186 A * 2/1928 Corson ..... 148/553
2,192,497 A * 3/1940 Hessenbruch ..... 420/490
3,683,103 A 8/1972 Mancino
6,649,843 B2 * 11/2003 Aoyama et al. ..... 174/126.1
2003/0037957 A1 2/2003 Ueno et al.
2006/0102368 A1 5/2006 Michel et al.

FOREIGN PATENT DOCUMENTS

EP 1191545 3/2002
FR 2687500 8/1993
WO 2007015345 2/2007

OTHER PUBLICATIONS

French Search Report dated Mar. 17, 2008.

* cited by examiner

*Primary Examiner*—Chau N Nguyen
(74) *Attorney, Agent, or Firm*—Sofer & Haroun, LLP

(57) ABSTRACT

The invention relates to a data transmission electric wire comprising a plurality of conductor strands covered in at least one insulating covering including PTFE, the plurality of strands comprising an inner core of first strands covered by at least one outer layer of second strands, said first and second strands being constituted of different metals, the metal of said second conductor strands presenting hardness that is lower than that of the metal of said first conductors, and said first strands being constituted essentially by an alloy of copper and said second strands being constituted essentially of copper. According to the invention, said alloy is a homogeneous copper alloy in the alpha phase that is stable at a temperature less than or equal to 500° C.

9 Claims, 2 Drawing Sheets

SIGNAL TRANSMISSION ELECTRIC WIRE FOR THE AVIATION AND SPACE INDUSTRIES

RELATED APPLICATIONS

This application claims the benefit of French Patent Application No. 07 56393, filed on Jul. 10, 2007, the entirety of which is incorporated herein by reference

FIELD OF THE INVENTION

The invention relates to a signal transmission electric wire for use in the aviation and space industries.

BACKGROUND OF THE INVENTION

More precisely, the invention relates to a data transmission electric wire made up of a plurality of conductor strands covered in at least one insulating covering.

Such known wires for the aviation industry comprise conductor strands made of a copper alloy together with an insulating covering comprising an inner tape of polyimide and an outer tape of polytetrafluoroethylene (PTFE). The use of a layer of PTFE serves in particular to improve the ability of the insulating wire to withstand electric arc propagation. The use of a layer of polyimide serves in particular to provide mechanical strength to the insulating covering the cable.

In specific applications such as wires and cables for the aviation and space industries, wires of this type need to be designed so as to present small weight and volume. It is therefore desired to make such an electric wire with a section of about 0.2 square millimeters ($mm^2$) to 0.4 $mm^2$.

For reasons of safety, it is also important for the insulating covering of the wire to present high levels of resistance to cutting and to abrasion, whether by scraping or between wires.

Ordinary polyimides (e.g. sold under the trademarks Kapton® or Apical®, of the 616 type and having a thickness of 30 micrometers (μm)) present high levels of mechanical performance, so an insulating covering that includes them presents relatively high levels of resistance to cutting and to abrasion. In particular, they have been used for more than 30 years in structures with polyimide insulation that do not include PTFE tape (see Table 1, reference CF24), but such structures do not withstand electric arc propagation.

The use of such polyimide 616 tapes in a wire having a core section of 0.2 $mm^2$ with an insulating covering combining polyimide and PTFE, presenting a diameter and a weight that can be close of the structure having the reference CF24, makes it possible to obtain satisfactory resistance to arc propagation, but does not make it possible to obtain insulation with satisfactory resistance to cutting and to abrasion (cf. Table 1, ref. DR24-616). In order to make a wire having a section of 0.2 $mm^2$ and of diameter and weight close to those of the structure referenced CF24, that can withstand electric arc propagation, and that presents insulation with acceptable mechanical properties, it is the practice to use polyimide tapes of smaller thickness, of the order of 22 μm, and of cost and mechanical strength that are higher than those of the 616 tape (trademarks Oasis® or Apical®, and of type 171). Such wires (cf. Table 1, ref. DR24-171) advantageously take the place on aircraft of wires that do not withstand electric arc propagation and that are referenced CF24.

In order to further increase mechanical performance, it can be envisaged to make use of a polyimide of a new generation, that presents better mechanical performance, however such a polyimide is much more expensive than tapes of polyimide 616 or 171, thereby leading to an electric wire that is much too expensive (cf. Table 1, ref. DR24-161).

OBJECTS AND SUMMARY OF THE INVENTION

The invention solves this problem by using an insulating covering presenting mechanical, electrical, and dimensional characteristics that are acceptable and of low cost.

To achieve this, the invention provides a data transmission electric wire comprising a plurality of conductor strands covered in at least one insulating covering that includes PTFE, the plurality of strands comprising an inner core of first strands covered by at least one outer layer of second strands, said first and second strands being made of different metals, the metal of said second strands presenting hardness that is less than the hardness of the metal of said first strand.

By means of the invention, when a load is applied on the electric wire, during a cutting test or an abrasion test by scraping, the peripheral strands of smaller hardness tend to deform by being compressed so as to spread out the cutting or abrasion force from the insulating covering over a larger area. Resistance to cutting that is greater than 120 newtons (N) and resistance to abrasion under a force of 8 N that is greater than or equal to 150 cycles can thus be obtained when using a steel needle having a diameter of 0.50 millimeters (mm) and testing an electric wire with a section of 0.2 $mm^2$ and making use of an insulating covering that presents ordinary mechanical characteristics and small cost. (Cf. Table 1, reference "DR24-616 composite 3+9" and reference "DR24-616 composite 7+12").

Patent document US 2003/037957 describes such a cable in which said first strands can be constituted by a copper alloy having 2% to 10% by weight of silver or of niobium, and reinforced by fibers, while said second strands are constituted essentially by copper. According to that document, an insulating covering of ethylene-tetrafluoroethylene (E-TFE) copolymer resin can be used.

When using an insulating covering of PTFE, the covering needs to be baked for about 1 minute at a temperature that is greater than its melting temperature of 342° C., which operation is also known as sintering. A temperature lying in the range 380° C. to 400° C. is generally applied during this operation of baking the PTFE covering. When using an alloy of copper and silver or niobium, as described in that document, the alloy begins to anneal at that temperature.

Furthermore, a copper alloy having 2% to 10% by weight of silver or of niobium, as described in that prior document, presents an alpha phase over only a small domain of composition, which can lead to difficulties in terms of preparation and working. The preparation of such an alloy presents risks of obtaining precipitates or components that are undefined.

Furthermore, in the context of an application to the aviation and space industries, the cable must be capable of withstanding prolonged exposure to a temperature of 260° C., for a duration of the order of 10,000 hours.

Unfortunately, the breaking strength of an alloy of copper and silver or niobium can become about 400 megapascals (MPa) to 500 MPa on being subjected to a temperature of 260° C. over a long period.

The invention solves these technical problems by proposing a data transmission electric wire comprising a plurality of conductor strands covered in at least one insulating covering including PTFE, and that is capable of withstanding a continuous in-service temperature of 260° C.

To do this, the invention provides a data transmission electric wire comprising a plurality of conductor strands covered in at least one insulating covering including PTFE, the plurality of strands comprising an inner core of first strands covered by at least one outer layer of second strands, said first and second strands being constituted of different metals, the metal of said second conductor strands presenting hardness that is lower than that of the metal of said first conductors, said first strands being constituted essentially by an alloy of copper, and said second strands being constituted essentially of copper, wherein said alloy is a homogeneous copper alloy in the alpha phase that is stable at a temperature less than or equal to 500° C.

The copper alloy, compared with steel, presents the advantage of being an excellent conductor and the first strands present breaking strength greater than 650 MPa.

In a preferred embodiment, said copper alloy is an alloy of copper, nickel, and silicon.

Said copper alloy may comprise, by weight, at least 95% copper and at least 2% nickel, and preferably, it comprises, by weight, 96.5% copper, 2.5% nickel, and 0.6% silicon.

Said copper alloy may also be an alloy of copper, cobalt, and beryllium.

Said copper alloy may comprise by weight, at least 95% copper and 0.5% to 2% beryllium.

Said first strands may be coated in a layer of metal providing protection against oxidation.

Said second strands may be coated in a layer of metal providing protection against oxidation.

Advantageously, the layer of metal providing protection against oxidation has a thickness of at least 1 μm.

Preferably, the cable includes an inner, first insulating covering made of polyimide, of ordinary characteristics and low cost.

Preferably, said outer layer of second strands is concentric with said inner layer of first strands.

BRIEF DESCRIPTION OF THE DRAWINGS

The invention is described below in greater detail with the help of figures that merely show preferred embodiments.

FIG. 1 shows an electric wire comprising twelve conductor strands.

MORE DETAILED DESCRIPTION

Figure 1:
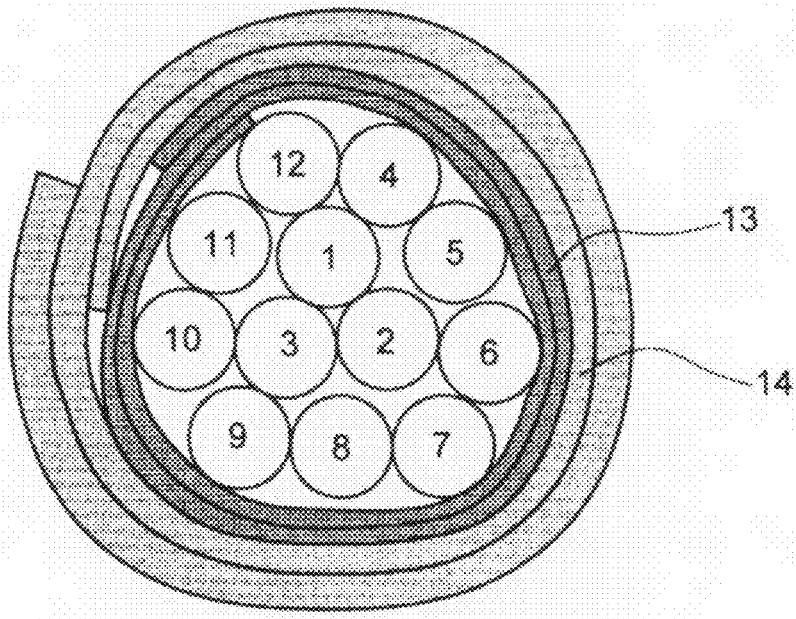
FIG. 1 is a cross-section view of an electric wire, of the invention made up of twelve conductor strands.

An inner core of first strands comprises three strands 1 to 3 and is covered in a concentric layer of second strands that constitute nine strands, numbered 4 to 12, all of these conductor strands being of identical diameter, less than 1 mm, and preferably of the order of 0.1 mm, and being twisted together.

The first strands are made of a copper alloy possibly coated in a layer of nickel having a thickness of about 1.3 μm, and the second strands are constituted by copper that is possibly likewise coated in a layer of nickel having a thickness of about 1.3 μm.

The first strands of copper alloy present breaking strength of at least 650 MPa and elongation lying in the range 8% to 13%.

The cooper alloy may be an alloy of copper, nickel, and silicon. The copper alloy preferably comprises, by weight, at least 95% copper, and at least 2% nickel, and it preferably comprises 96.5% copper, 2.5% nickel, and 0.6% silicon. Such an alloy presents hardness lying in the range 120 to 160 on the Vickers scale.

It is also possible to use an alloy of copper, cobalt, and beryllium that comprises, by weight, at least 95% copper, and 0.5% to 2% beryllium. Such an alloy presents hardness of the order of 200 on the Vickers scale.

The second strands made of copper present a breaking strength lying in the range 200 MPa to 220 MPa, with elongation lying in the range 10% to 25%, and hardness of the order of 50 on the Vickers scale.

The outer layer of second strands is preferably concentric about the inner core of first strands.

It does not matter whether the successive concentric layers are twisted in the same direction or not, and likewise it does not matter whether they are twisted to the same pitch or not. The pitch to which the outer layer is twisted preferably lies in the range 8 times to 16 times the outside diameter of the twisted strand.

This composite twisted strand is covered in a first insulating covering 13 made up of a tape of polyimide that is taped on. This layer is itself covered in an outer, second insulating covering 14 made up of a PTFE tape that is taped in the opposite direction to the polyimide tape.

In a preferred embodiment, the conductor strands have a diameter of 0.15 mm, the polyimide tape has a thickness of 0.03 mm, and the PTFE tape has a thickness close to 0.05 mm. Two polyimide tape thicknesses and two PTFE tape thicknesses are applied and sealed by heat treatment (cf. Table 1, reference "DR24-616 composite 3+9").

This twisted strand made up of 3+9 strands produces satisfactory mechanical and insulating characteristics, however its breaking strength is less than the requirement for a minimum strength of 350 MPa.

An electric wire of the invention, comprising a conductor in which the proportion of copper wires is less than above, can solve that lack of strength.

Figure 2:
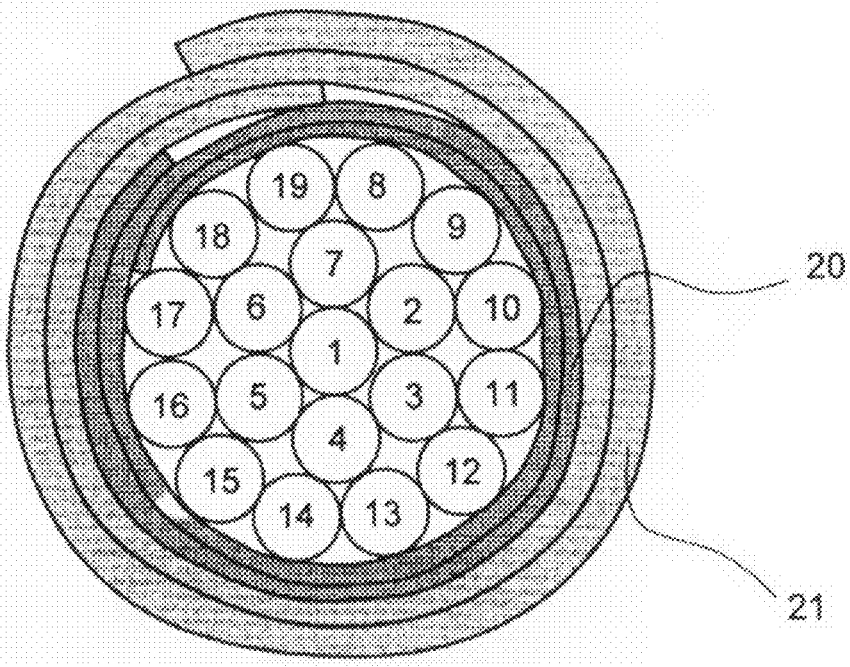
FIG. 2 is a cross-section view of an electric wire of the invention comprising nineteen conductor strands.

FIG. 2 shows an electric wire comprising nineteen conductor strands.

An inner core of first strands comprises seven strands numbered 1 to 7, and it is covered in a concentric layer of twelve second strands that are numbered 8 to 19, all of these conductor strands being twisted together and being identical in diameter, less than 1 mm, and preferably about 0.1 mm.

The first strands are constituted by a copper alloy optionally coated in a layer of nickel having a thickness of about 1.3 μm, and the second strands are constituted by copper that is optionally likewise coated in a layer of nickel having a thickness of about 1.3 μm.

Advantageously, the copper alloy is an alloy of copper, nickel, and silicon. The copper alloy preferably comprises, by weight, at least 95% copper, and at least 2% nickel, and preferably comprises, by weight, 96.5% copper, 2.5% nickel, and up to 0.6% silicon.

This composite twisted strand is coated in a first insulating covering 20 constituted by a taped-on polyimide tape having ordinary characteristics and low cost, which is in turn covered in an outer second insulating covering 21 constituted by a PTFE tape that is taped in the opposite direction.

As an example of a preferred embodiment, the conductor strands have a diameter of 0.115 mm, the polyimide tape has a thickness of 0.03 mm, and the PTFE tape has a thickness of 0.05 mm. Two thicknesses of polyimide tape and two thicknesses of PTFE tape are applied and sealed by heat treatment (cf. Table 1 reference "DR24-616 composite 7+12").

Figure 3:
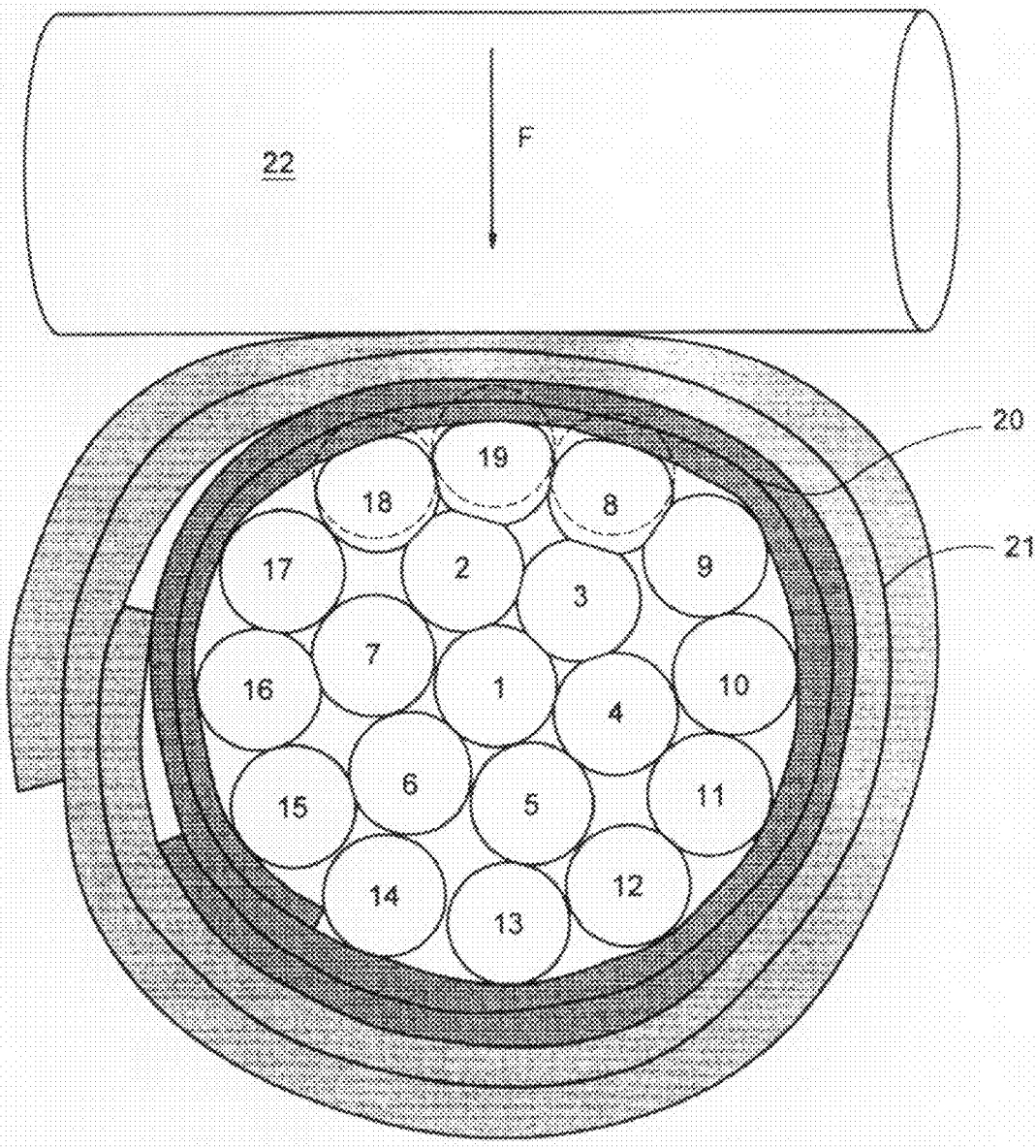
FIG. 3 is a cross-section view showing an abrasion or cutting test on an electric wire in accordance with the invention.

FIG. 3 is a cross-section view showing an abrasion or cutting test on an electric wire in accordance with the invention.

During the test of cutting or abrasion by scraping, a needle 22 is pressed against the cable and is subjected to a certain load.

By means of the invention, when this load is applied to the cable, the peripheral strands 8, 18, and 19, which are essentially made of copper with hardness less than that of the inner core strands, 1 to 7, and which are located close to the needle, tend to deform under compression and to distribute the cutting or abrasion force from the insulating cover 20, 21. The abrasion or cutting pressure to which the insulating sheath is subjected is thus reduced.

Resistance to cutting of more than 120 newtons (N) and resistance to abrasion under a force of 8 N that is greater than or equal to 150 cycles can thus be obtained while using a steel needle having a diameter of 0.50 mm, when testing an electric wire having a section of 0.2 $mm^2$, a diameter of 0.9 mm, and an insulating covering with ordinary mechanical characteristics and of low cost.

It is thus possible to use for the insulating covering an inner tape of polyimide 13 having ordinary mechanical properties and low cost, with a thickness of about 30 μm. By way of example, for the inner insulating covering, it is possible to use a polyimide of reference 616 as sold by DuPont de Nemours under the trademark Kapton® and by Kaneka under the trademark Apical®.

TABLE I

COMPARISON OF AVIATION WIRES WITH A SECTION OF 0.2 $mm^2$

| Performance/wire | Wanted | CF24 | DR24-616 | DR24-171 | DR24-161 | DR24-616 composite 3 + 9 | DR24-616 composite 7 + 12 |
|---|---|---|---|---|---|---|---|
| Description | — | Polymide-insulated prior art wire | Wire insulated with polymide + non compliant PTFE | Polymide + PTFE insulated prior art wire | Higher performance polymide + PTFE insulated wire | Wire of the invention 3 + 9 twisted strands | Wire of the invention 7 + 12 twisted strands |
| Nickel-plated core | 19 x 0.12 copper alloy | 19 x 0.12 copper alloy | 19 x 0.115 copper alloy | 19 x 0.115 copper alloy | 19 x 0.115 copper alloy | 12 x 0.15 3 alloy + 9 copper | 19 x 0.115 7 alloy + 12 copper |
| Insulation 1 | — | polyimide 616 | polyimide 616 | polyimide 171 | polyimide 161 | polyimide 616 | polyimide 616 |
| Insulation 2 | — | polyimide 616 | PTFE | PTFE | PTFE | PTFE | PTFE |
| Insulation 3 | — | Varnish | — | — | — | — | — |
| Core rupture R (N) | >67 | 73 | 76 | 75 | 74 | 72 | 75 |
| Core rupture R (MPa) | >350 | 370 | 384 | 380 | 375 | 335 | 384 |
| All rupture (%) | >6 | 16 | 16 | 22 | 20 | 11 | 13 |
| Nominal weight (kg/km) | DR24 < 2.72 | 2.51 | 2.60 | 2.64 | 2.52 | 2.64 | 2.56 |
| Linear resistance (ohm/km) | <114.0 | 98 | 100 | 100 | 100 | 102.5 | 110.5 |
| Nominal diameter (mm) | 0.85 < DR24 < 0.96 | 0.90 | 0.93 | 0.92 | 0.89 | 0.94 | 0.91 |
| Dry arc propagation: collateral damage | <25% | >70 | 0 | 0 | 0 | 0 | 0 |
| Resistance to cutting (N) | >85 | 215 | 75 | 129 | 144 | 125 | 129 |
| Resistance to abrasion at 8N (cycles) | >100 | 180 | 55 | 134 | 226 | 150 | 160 |

What is claimed is:

1. A data transmission electric wire comprising:

a plurality of conductor strands covered in at least one insulating covering including PTFE and an inner, first covering made of polyimide, wherein the plurality of strands has an inner core of first strands covered by at least one outer layer of second strands, said first and second strands being made of different metals, the metal of said second conductor strands presenting hardness that is lower than that of the metal of said first conductors, said first strands being substantially an alloy of copper, and said second strands being substantially copper, wherein said alloy of copper is a homogeneous copper alloy in the alpha phase that is stable at a temperature less than or equal to 500° C.

2. An electric wire according to claim 1, wherein said copper alloy is an alloy of copper, nickel, and silicon.

3. An electric wire according to the claim 2, wherein said copper alloy comprises, by weight, at least 95% copper and at least 2% nickel.

4. An electric wire according to claim 1, wherein said copper alloy is an alloy of copper, cobalt, and beryllium.

5. An electric wire according to claim 4, wherein said copper alloy comprises by weight, at least 95% copper and 0.5% to 2% beryllium.

6. An electric wire according to claim 1, wherein said first strands are coated in a layer of metal providing protection against oxidation.

7. An electric wire according to claim 1, wherein said second strands are coated in a layer of metal providing protection against oxidation.

8. An electric wire according to claim 6, wherein said layer of metal providing protection against oxidation has a thickness of at least 1 μm.

9. An electric wire according to claim 1, wherein said outer layer of second strands is concentric with said inner layer of first strands.

* * * * *

UNITED STATES PATENT AND TRADEMARK OFFICE

CERTIFICATE OF CORRECTION

PATENT NO. : 7,772,497 B2
APPLICATION NO. : 12/217296
DATED : August 10, 2010
INVENTOR(S) : Pascal Clouet, Jean-Pierre Ferlier and Louis Salvat It is certified that error appears in the above-identified patent and that said Letters Patent is hereby corrected as shown below:

On the Title Page
Item (73) Assignee: should read, Nexans (FR) and FSP ONE (FR)

Signed and Sealed this
Twenty-sixth Day of July, 2011

David J. Kappos

David J. Kappos
*Director of the United States Patent and Trademark Office*